US009151453B2

(12) United States Patent
Holland et al.

(10) Patent No.: US 9,151,453 B2
(45) Date of Patent: Oct. 6, 2015

(54) MAGNETICALLY-MOUNTABLE LIGHTING DEVICE AND ASSOCIATED SYSTEMS AND METHODS

(71) Applicant: Lighting Science Group Corporation, Satellite Beach, CA (US)

(72) Inventors: Eric Holland, Indian Harbour Beach, FL (US); Mark Penley Boomgaarden, Satellite Beach, FL (US); Eric Thosteson, Satellite Beach, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 0 days.

(21) Appl. No.: 13/832,969

(22) Filed: Mar. 15, 2013

(65) Prior Publication Data

US 2014/0268768 A1 Sep. 18, 2014

(51) Int. Cl.

| | |
|---|---|
| ***F21S 4/00*** | (2006.01) |
| ***F21K 99/00*** | (2010.01) |
| *F21V 23/00* | (2015.01) |
| *F21Y 101/02* | (2006.01) |
| *F21Y 105/00* | (2006.01) |

(Continued)

(52) U.S. Cl.

CPC ..... *F21K 9/30* (2013.01); *F21V 23/006* (2013.01); *F21V 23/045* (2013.01); *F21V 29/773* (2015.01); *F21Y 2101/02* (2013.01); *F21Y 2105/001* (2013.01); *Y10T 29/49826* (2015.01)

(58) Field of Classification Search

CPC ..... F21K 9/00; F21K 9/30; F21V 19/00; F21V 21/096

USPC ..... 362/235, 240, 249.11

See application file for complete search history.

(56) References Cited

U.S. PATENT DOCUMENTS

| | | | | |
|---|---|---|---|---|
| 1,703,524 | A * | 2/1929 | Grandjean | 315/209 R |
| 2,669,650 | A * | 2/1954 | Smith | 362/388 |
| 3,201,542 | A * | 8/1965 | Hutchison | 335/207 |

(Continued)

FOREIGN PATENT DOCUMENTS

| | | | |
|---|---|---|---|
| CN | 101 702 421 | A | 5/2010 |
| WO | WO 2009/121539 | A1 | 10/2009 |
| WO | WO 2012/158665 | | 11/2012 |

OTHER PUBLICATIONS

U.S. Appl. No. 13/739,893, Jan. 2013, Holland et al.

(Continued)

*Primary Examiner* — Robert May
*Assistant Examiner* — Bryon T Gyllstrom
(74) *Attorney, Agent, or Firm* — Mark Malek; William Harding; Widerman Malek, PL

(57) ABSTRACT

A lighting device comprising a heat sink, a light source in thermal communication with the heat sink, and a power source operably coupled with the light source. The heat sink, light source, and power source are positioned in a cavity defined by an enclosure and an optic which present a puck-like shape when assembled. A magnetic attachment member installed in the cavity of the enclosure magnetically binds the lighting device to a ferromagnetic material external to the lighting device. The power source receives an AC input voltage through inductive and/or conductive coupling, and converts the voltage to DC to support light-emitting diodes (LEDs). A controller may operate the light source based on instructions transmitted by a beam adjustment device and/or an occupancy sensor. A method aspect of the invention details steps for assembling the lighting device.

20 Claims, 11 Drawing Sheets

(51) Int. Cl.
*F21V 23/04* (2006.01)
*F21V 29/77* (2015.01)

(56) References Cited

U.S. PATENT DOCUMENTS

| | | | | |
|---|---|---|---|---|
| 3,325,639 | A * | 6/1967 | King | 362/270 |
| 3,706,882 | A * | 12/1972 | Eby | 362/398 |
| 3,917,940 | A * | 11/1975 | Duddy | 362/398 |
| 4,318,159 | A * | 3/1982 | Kaisner | 362/124 |
| 4,506,317 | A * | 3/1985 | Duddy | 362/396 |
| 5,221,877 | A | 6/1993 | Falk | |
| 5,457,619 | A * | 10/1995 | Ewing | 362/398 |
| 5,523,878 | A | 6/1996 | Wallace et al. | |
| 5,680,230 | A * | 10/1997 | Kaburagi et al. | 358/520 |
| 5,704,701 | A | 1/1998 | Kavanagh et al. | |
| 5,997,150 | A | 12/1999 | Anderson | |
| 6,027,225 | A | 2/2000 | Martin et al. | |
| 6,140,646 | A | 10/2000 | Busta et al. | |
| 6,341,876 | B1 | 1/2002 | Moss et al. | |
| 6,356,700 | B1 | 3/2002 | Strobl | |
| 6,369,517 | B2 | 4/2002 | Song et al. | |
| 6,594,090 | B2 | 7/2003 | Kruschwitz et al. | |
| 6,641,283 | B1 * | 11/2003 | Bohler | 362/238 |
| 6,767,111 | B1 * | 7/2004 | Lai | 362/240 |
| 6,817,735 | B2 | 11/2004 | Shimizu et al. | |
| 6,870,523 | B1 | 3/2005 | Ben-David et al. | |
| 6,871,982 | B2 | 3/2005 | Holman et al. | |
| 6,974,713 | B2 | 12/2005 | Patel et al. | |
| 7,072,096 | B2 | 7/2006 | Holman et al. | |
| 7,075,707 | B1 | 7/2006 | Rapaport et al. | |
| 7,083,304 | B2 | 8/2006 | Rhoads | |
| 7,178,941 | B2 | 2/2007 | Roberge et al. | |
| 7,246,923 | B2 | 7/2007 | Conner | |
| 7,255,469 | B2 | 8/2007 | Wheatley et al. | |
| 7,261,453 | B2 | 8/2007 | Morejon et al. | |
| 7,289,090 | B2 | 10/2007 | Morgan | |
| 7,300,177 | B2 | 11/2007 | Conner | |
| 7,303,291 | B2 | 12/2007 | Ikeda et al. | |
| 7,325,956 | B2 | 2/2008 | Morejon et al. | |
| 7,342,658 | B2 | 3/2008 | Kowarz et al. | |
| 7,349,095 | B2 | 3/2008 | Kurosaki | |
| 7,400,439 | B2 | 7/2008 | Holman | |
| 7,429,983 | B2 | 9/2008 | Islam | |
| 7,434,946 | B2 | 10/2008 | Huibers | |
| 7,436,996 | B2 | 10/2008 | Ben-Chorin | |
| 7,438,443 | B2 | 10/2008 | Tatsuno et al. | |
| 7,476,016 | B2 | 1/2009 | Kurihara | |
| 7,479,861 | B2 | 1/2009 | Zepke et al. | |
| 7,520,642 | B2 | 4/2009 | Holman et al. | |
| 7,530,708 | B2 | 5/2009 | Park | |
| 7,540,616 | B2 | 6/2009 | Conner | |
| 7,556,406 | B2 | 7/2009 | Petroski et al. | |
| 7,598,686 | B2 | 10/2009 | Lys et al. | |
| 7,598,961 | B2 | 10/2009 | Higgins | |
| 7,626,755 | B2 | 12/2009 | Furuya et al. | |
| 7,677,736 | B2 | 3/2010 | Kasazumi et al. | |
| 7,684,007 | B2 | 3/2010 | Hull et al. | |
| 7,703,943 | B2 | 4/2010 | Li et al. | |
| 7,705,810 | B2 | 4/2010 | Choi et al. | |
| 7,709,811 | B2 | 5/2010 | Conner | |
| 7,719,766 | B2 | 5/2010 | Grasser et al. | |
| 7,728,846 | B2 | 6/2010 | Higgins et al. | |
| 7,766,490 | B2 | 8/2010 | Harbers et al. | |
| 7,806,575 | B2 | 10/2010 | Willwohl et al. | |
| 7,824,075 | B2 | 11/2010 | Maxik et al. | |
| 7,828,453 | B2 | 11/2010 | Tran et al. | |
| 7,832,878 | B2 | 11/2010 | Brukilacchio et al. | |
| 7,834,867 | B2 | 11/2010 | Sprague et al. | |
| 7,845,823 | B2 | 12/2010 | Mueller et al. | |
| 7,905,637 | B2 | 3/2011 | Caluori et al. | |
| 7,922,356 | B2 | 4/2011 | Maxik et al. | |
| 8,016,443 | B2 | 9/2011 | Falicoff et al. | |
| 8,047,660 | B2 | 11/2011 | Penn et al. | |
| 8,049,763 | B2 | 11/2011 | Kwak et al. | |
| 8,083,364 | B2 | 12/2011 | Allen | |
| 8,096,668 | B2 | 1/2012 | Abu-Ageel | |
| 8,172,436 | B2 | 5/2012 | Coleman et al. | |
| 8,212,836 | B2 | 7/2012 | Matsumoto et al. | |
| 8,297,783 | B2 | 10/2012 | Kim | |
| 8,331,099 | B2 | 12/2012 | Geissler et al. | |
| 8,337,029 | B2 | 12/2012 | Li | |
| 8,384,984 | B2 | 2/2013 | Maxik et al. | |
| 2004/0052076 | A1 * | 3/2004 | Mueller et al. | 362/293 |
| 2006/0002108 | A1 | 1/2006 | Ouderkirk et al. | |
| 2006/0002110 | A1 | 1/2006 | Dowling et al. | |
| 2006/0164005 | A1 | 7/2006 | Sun | |
| 2006/0285193 | A1 | 12/2006 | Kimura et al. | |
| 2007/0013871 | A1 | 1/2007 | Marshall et al. | |
| 2007/0159492 | A1 | 7/2007 | Lo et al. | |
| 2008/0143973 | A1 | 6/2008 | Wu | |
| 2008/0198572 | A1 | 8/2008 | Medendorp | |
| 2008/0232084 | A1 | 9/2008 | Kon | |
| 2008/0285271 | A1 * | 11/2008 | Roberge et al. | 362/235 |
| 2009/0027900 | A1 | 1/2009 | Janos et al. | |
| 2009/0036952 | A1 | 2/2009 | Kao et al. | |
| 2009/0059585 | A1 | 3/2009 | Chen et al. | |
| 2009/0128781 | A1 | 5/2009 | Li | |
| 2010/0006762 | A1 | 1/2010 | Yoshida et al. | |
| 2010/0202129 | A1 | 8/2010 | Abu-Ageel | |
| 2010/0231863 | A1 | 9/2010 | Hikmet et al. | |
| 2010/0244700 | A1 | 9/2010 | Chong et al. | |
| 2010/0315320 | A1 | 12/2010 | Yoshida | |
| 2010/0320928 | A1 | 12/2010 | Kaihotsu et al. | |
| 2010/0321641 | A1 | 12/2010 | Van Der Lubbe | |
| 2011/0310446 | A1 | 12/2011 | Komatsu | |
| 2012/0140440 | A1 | 6/2012 | Dam et al. | |
| 2012/0188769 | A1 | 7/2012 | Lau | |
| 2012/0286700 | A1 | 11/2012 | Maxik et al. | |
| 2013/0099696 | A1 | 4/2013 | Maxik et al. | |

OTHER PUBLICATIONS

Sengupta, Upal, "How to Implement a 5-W Wireless Power System", How2Power Today, pp. 1-8, (Jul. 2010).

* cited by examiner

MAGNETICALLY-MOUNTABLE LIGHTING DEVICE AND ASSOCIATED SYSTEMS AND METHODS

FIELD OF THE INVENTION

The present invention relates to the field of lighting and, more specifically, to lighting devices used to replace legacy lamps, and associated systems and methods.

BACKGROUND OF THE INVENTION

Both incandescent and fluorescent lamps are commonly used in residential, commercial, and institutional applications. However, both types of lighting solutions suffer from certain disadvantages. For example, incandescent lamps convert approximately 3% of electrical power consumed into usable light, while the remaining 97% of power may be wasted as heat. Compared to an incandescent lamp, a fluorescent lamp converts electrical power into useful light more efficiently, delivers a significantly longer useful life, and presents a more diffuse and physically larger light source. However, fluorescent lamps are typically more expensive to install and operate than an incandescent lamp because of the requirement for a ballast to regulate the electrical current. Many fluorescent lamps have poor color temperature, resulting in a less aesthetically pleasing light. Also, if a fluorescent lamp that uses mercury vapor is broken, a small amount of mercury (classified as hazardous waste) can contaminate the surrounding environment.

Digital lighting technologies such as light-emitting diodes (LEDs) offer significant advantages over legacy incandescent and fluorescent lamps. These advantages include but are not limited to better lighting quality, longer operating life, and lower energy consumption. Consequently, a market exists for LED-based retrofit alternatives to legacy lighting fixtures. However, a number of installation challenges and costs are associated with replacing legacy lamps with LED illumination devices. The challenges may, for example, include light output, thermal management, and ease of installation. The costs, which are similarly understood by those skilled in the art, typically stem from a need to replace or reconfigure fixtures configured to support legacy lamps to support LEDs instead.

By the very nature of their design and operation, LEDs have a directional light output. Consequently, the light emitted by an LED may not have the nearly omni-directional and uniform light distribution of incandescent and fluorescent lamps. Although multiple LEDs can be used in a single lamp, lighting solutions employing LEDs do not have light distribution properties approximating or equaling the dispersion properties of traditional lamps.

Another challenge inherent to operating LEDs is heat. Thermal management describes a system's ability to draw heat away from the LED, either passively or actively. LEDs may suffer damage and decreased performance when operating in high-heat environments. Moreover, when operating in a confined environment, the heat generated by an LED, and its attending circuitry itself, can cause damage to the LED. Heat sinks are well known in the art and have been effectively used to provide cooling capacity to maintain an LED-based light bulb within a desirable operating temperature. However, heat sinks can sometimes negatively impact the light distribution properties of the light fixture, resulting in non-uniform distribution of light about the light fixture.

Power supply requirements of LED-based lighting systems can complicate installation of LEDs as a retrofit to existing light fixtures. LEDs are low-voltage light sources that require constant DC voltage or current to operate optimally, and therefore must be carefully regulated. Too little current and voltage may result in little or no light. Too much current and voltage can damage the light-emitting junction of the LED. LEDs are commonly supplemented with individual power adapters to convert AC power to the proper DC voltage, and to regulate the current flowing through during operation to protect the LEDs from line-voltage fluctuations.

Supporting mechanical attachment to a wide variety of existing light fixture types also complicates installation of retrofit lamps that employ LEDs. Because the retrofit lamp often does not match the form factor of the light source being replaced, alternative attachment mechanisms may be required. For example, mechanical fasteners may be screwed into new holes that may be drilled into the existing fixture to attach the retrofit LED-based light source. However, limited access to fastener mounting points on the existing fixture, and/or the risk of damaging the existing fixture may discourage the use of mechanical fasteners. In an alternative example, adhesives may be used to attach the retrofit LED-based light source to the existing fixture. However, not all fixture surfaces are conducive to adhesive attachment, particularly under temperature cycling typical of an LED-based lamp.

A need exists for a retrofit lighting device that may be easily and inexpensively mounted within the volume of space available in a variety of commercially-available light fixture configurations, and that may deliver improved lighting quality compared to traditional incandescent and fluorescent lamps. More specifically, a need exists for a retrofit lighting solution that benefits from the advantages of digital lighting technology, and is designed for ease of installation as well as for manufacturing cost reduction. The lighting industry is experiencing advancements in LED applications, some of which may be pertinent to certain aspects of replacing legacy lamps.

U.S. Pat. No. 7,806,575 to Willwohl et al. is directed to a LED lighting module having an LED element, an electronic driver arrangement, and a heat sink shaped to form a casing for the electronic driver arrangement. However, the disclosure presumes the availability of a power source external to the LED lighting module that may supply power to the electronic driver arrangement. Furthermore, the disclosure recites front mounting (rather than base mounting) that positions the LED lighting module to protrude through an opening in a reflector casing of a lighting assembly.

U.S. Pat. No. 6,641,283 to Bohler discloses an LED puck light having a mounting base and an LED module enclosing lighting components and circuitry. The LED module may include a fixing apparatus for attaching the module to a corresponding attachment apparatus on the mounting base. For example, the fixing apparatus may be a magnet, and the attachment apparatus may be an oppositely-charged magnet pole. However, the disclosed LED puck light offers no thermal management solution such as a heat sink.

U.S. Pat. No. 8,172,436 to Coleman et al. discloses an LED-based auxiliary puck light with a base and a pivoting head. A magnet affixed to the base may be strong enough to securely and fixedly hold the auxiliary puck light on a magnetic surface. However, like the Bohler reference, the Coleman disclosure offers no thermal management solution such as a heat sink.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to a lighting device adapted to be carried through magnetic binding to a ferromagnetic material. The lighting device may include a heat sink, a light source, a power source, and a magnetic attachment member. The lighting device also may include an enclosure and an optic.

The heat sink may be constructed of thermally conductive materials such as thermoplastic, ceramic, porcelain, aluminum, and/or aluminum alloys. The heat sink may be configured with heat-dissipating fins. The light source may be in thermal communication with the heat sink, and may comprise one or more light emitting diodes (LEDs). The power source may be operably coupled with the light source. The heat sink, the light source, and the power source may be mechanically coupled to the magnetic attachment member.

The power source may be in the form of an on-board power supply unit. The on-board power supply unit may have a converter that may convert an AC input voltage to a DC output voltage. The on-board power supply unit also may have a regulator that may sustain a DC output voltage within a target DC bias range. In one embodiment, the on-board power supply unit may have at least one induction coil configured to receive an AC input voltage through inductive coupling. In another embodiment, the on-board power supply unit may have at least one wire connector configured to receive the AC input voltage through conductive coupling. Alternatively, the power source may be in the form of at least one power terminal.

The enclosure may be generally puck-shaped and may include base and sidewall portions that may combine to define a cavity. The cavity may be configured to contain one or more of the heat sink, the light source, the power supply, and the magnetic attachment member. The enclosure also may be in thermal communication with the heat sink, the light source, and/or the power source. The optic may be attached to the enclosure so as to define an optical chamber into which light emitted by the light source may enter and subsequently pass through the optic.

Additionally, the lighting device may have a beam adjustment device and a controller. The beam adjustment device may electronically communicate beam characteristics to the controller. The controller may be programmed to selectively operate the light source in response to the beam characteristics received. The beam adjustment device may operate manually or automatically. A twist knob and/or a tunable lens may be employed for manual selection. An occupancy sensor and/or a timer may be employed for automatic selection. Operation of the beam adjustment device may be electrical, electronic, electromagnetic, or magnetic.

Furthermore, the lighting device may have a signal receiver and/or a signal transmitter. The controller may be programmed to selectively operate the light source in response to electronic communication received from an external device through the signal receiver. The controller also may be configured to transmit beam characteristics to an external device through the signal transmitter.

A method aspect of the present invention is for assembling a lighting device adapted to be carried through magnetic binding to a ferromagnetic material. The method may include the steps of forming the base and sidewall portions of the enclosure to define a cavity, positioning the light source in thermal communication with the heat sink, and positioning the light source in electrical communication with the power source. The method may further include inserting the heat sink, light source, and power source into the cavity of the enclosure, attaching the magnetic attachment member to the base and/or sidewall portions of the enclosure, and attaching the optic in a position substantially covering the cavity of the enclosure and such that the optic is in optical communication with the light source.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as “above,” “below,” “upper,” “lower,” and other like terms are used for the convenience of the reader in reference to the drawings. Also, a person skilled in the art should notice this description may contain other terminology to convey position, orientation, and direction without departing from the principles of the present invention. Like numbers refer to like elements throughout.

Referring now to FIGS. 1-7, a magnetically-mountable lighting device 100 according to an embodiment of the present invention is now described in detail. Throughout this disclosure, the present invention may be referred to as a lighting device 100, a lighting system, an LED lighting system, a lamp system, a lamp, a device, a system, a product, and a method. Those skilled in the art will appreciate that this terminology is only illustrative and does not affect the scope of the invention. For instance, the present invention may just as easily relate to lasers or other digital lighting technologies.

Example systems and methods for a magnetically-mountable lighting device are described herein below. In the following description, for purposes of explanation, numerous specific details are set forth to provide a thorough understanding of example embodiments. It will be evident, however, to one of ordinary skill in the art that the present invention may be practiced without these specific details and/or with different combinations of the details than are given here. Thus, specific embodiments are given for the purpose of simplified explanation and not limitation.

Figure 1A:
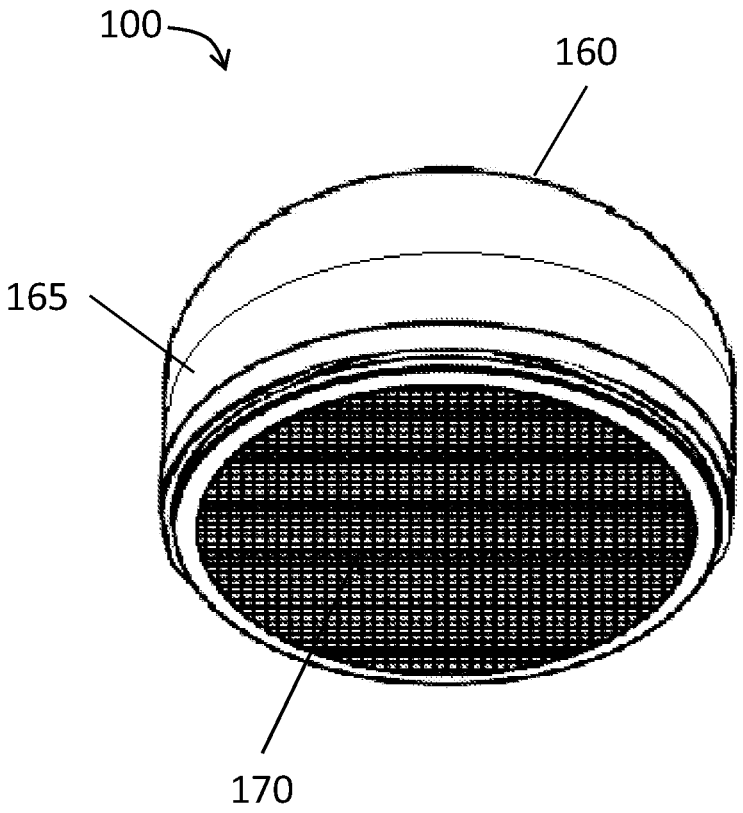
FIG. 1A is an assembled, perspective view of a magnetically-mountable lighting device according to an embodiment of the present invention.
Figure 1B:
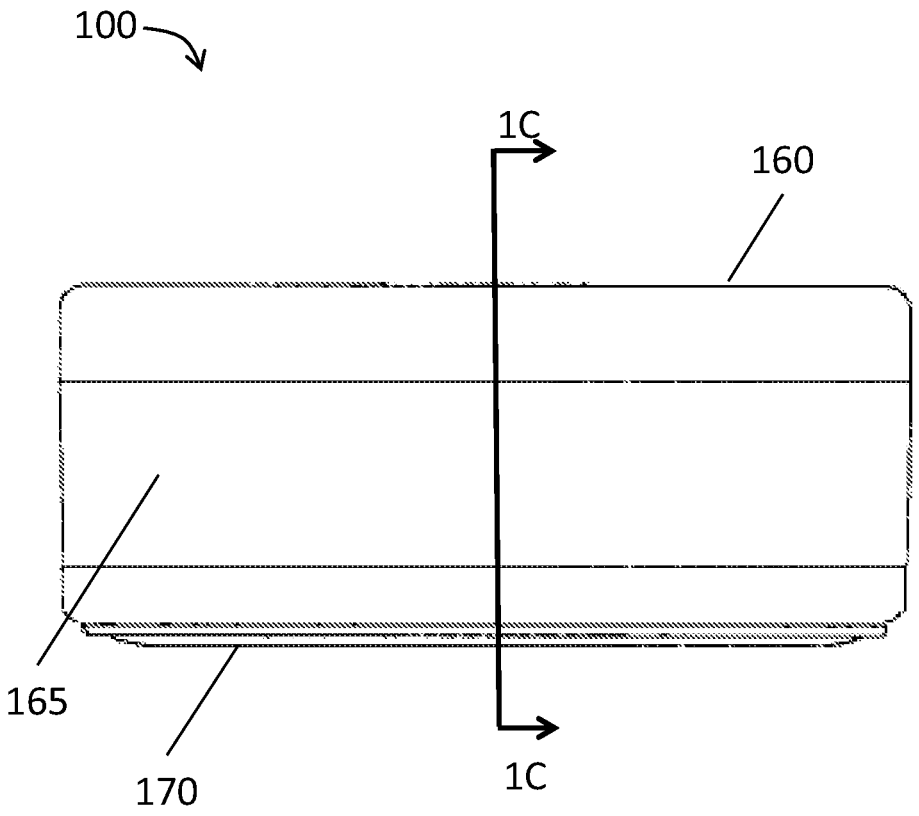
FIG. 1B is an assembled, front elevation view of the magnetically-mountable lighting device illustrated in FIG. 1A.
Figure 1C:
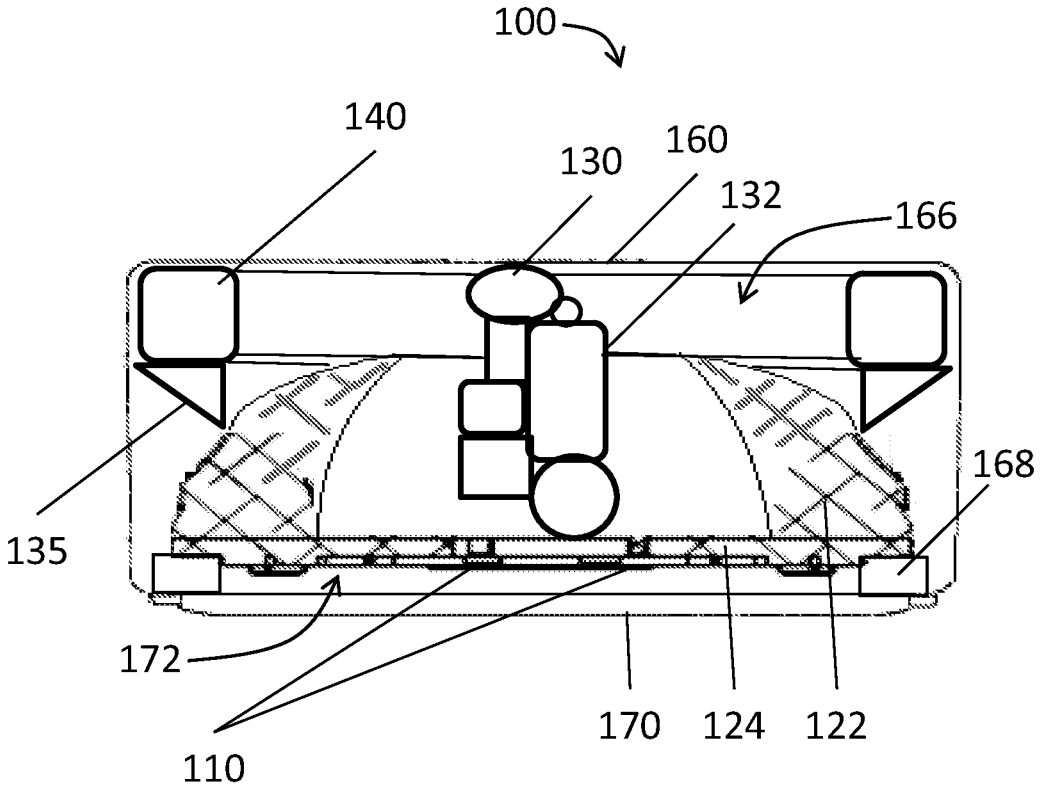
FIG. 1C is an assembled, cross-sectional view of the magnetically-mountable lighting device illustrated in FIG. 1A and taken through line 1C-1C of FIG. 1B.
Figure 1D:
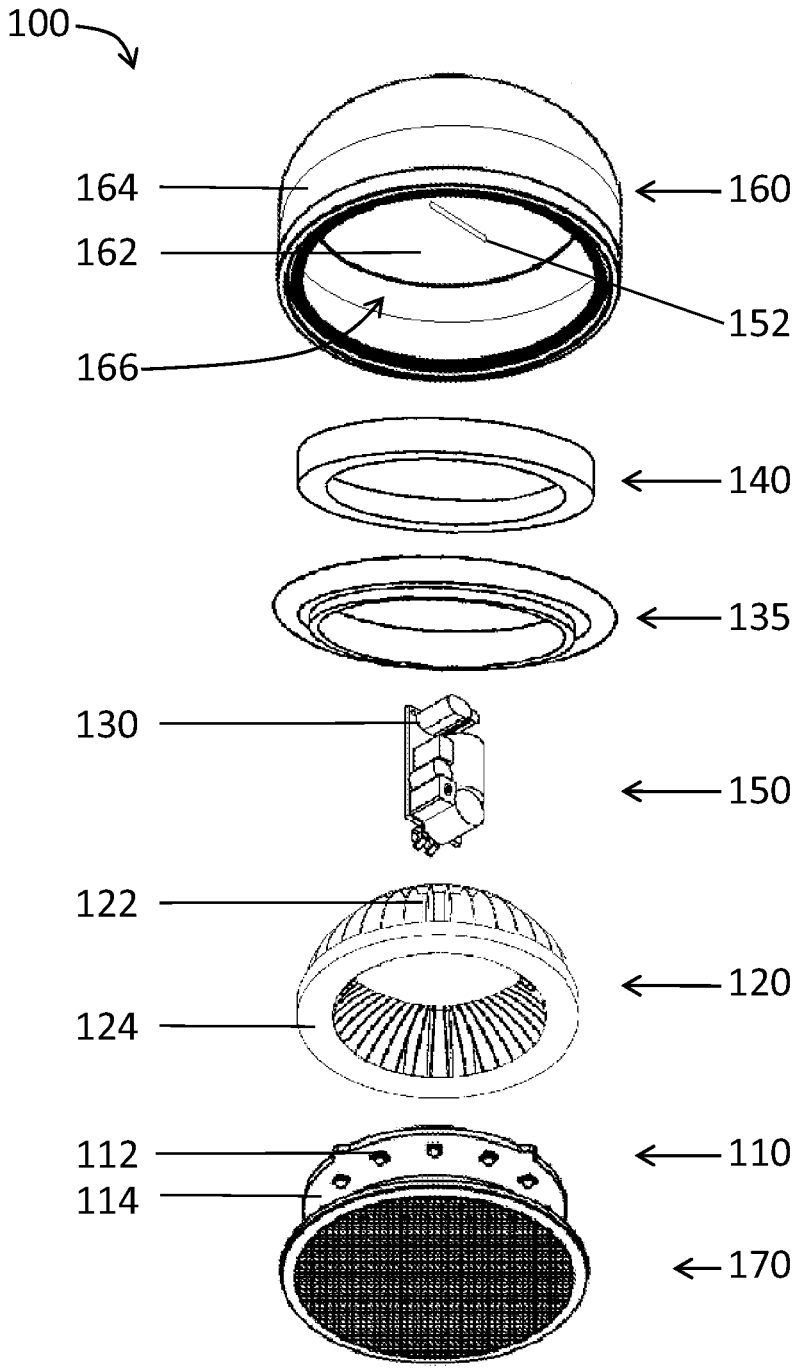
FIG. 1D is an exploded perspective view of the magnetically-mountable lighting device illustrated in FIG. 1A.

Referring now to FIGS. 1A, 1B, 1C, and 1D, a magnetically-mountable lighting device 100 will now be discussed. For purposes of definition, the term magnetically-mountable refers to adaptation to be carried through magnetic binding to a ferromagnetic material. Referring more specifically to FIGS. 1C and 1D, the lighting device 100, according to an embodiment of the present invention, may include a heat generating element 110, a heat sink 120, a power source 130, a magnetic attachment member 140, an enclosure 160, and an optic 170. The heat generating element 110 may be in the form of a light source. The components comprising the lighting device 100 may be connected by any means known in the art, including, not by limitation, use of adhesives or glues, welding, interference fit, and fasteners. Alternatively, one or more components of the lighting device 100 may be molded during manufacturing as an integral part of the lighting device 100.

Figure 2:
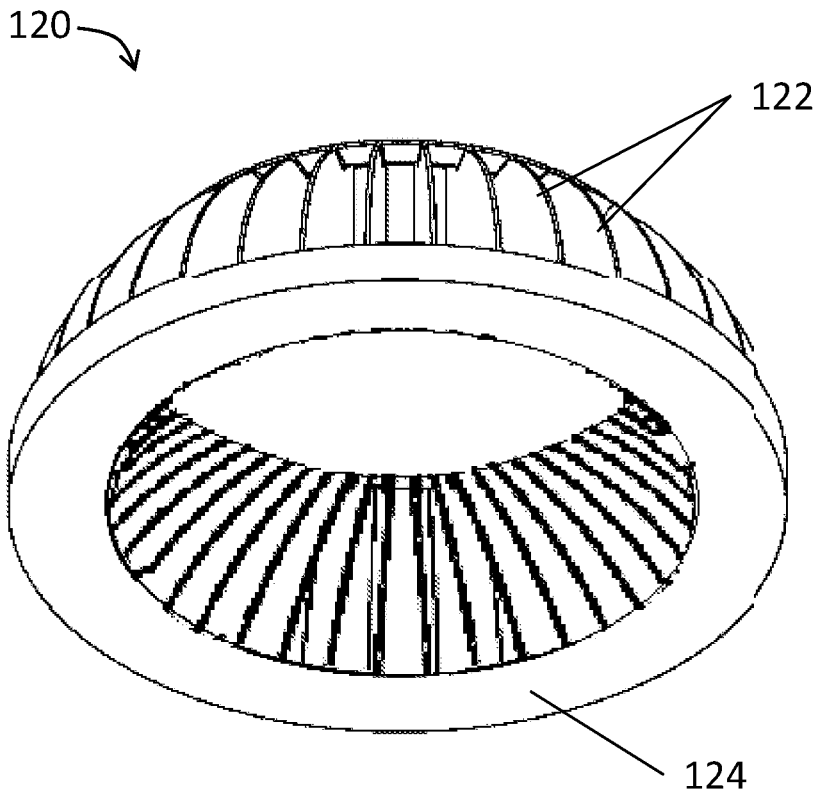
FIG. 2 is a perspective view of a heat sink of the magnetically-mountable lighting device depicted in FIG. 1A.

Referring now to FIG. 2, and continuing to refer to FIGS. 1C and 1D, the heat sink 120 of the lighting device 100, according to an embodiment of the present invention, is discussed in greater detail. Thermal management capability of the lighting device 100 according to an embodiment of the present invention may be provided by one or more heat sinks 120. More specifically, the heat sink 120 may be configured to be thermally coupled to elements of the lighting device 100 so as to increase the thermal dissipation capacity of the lighting device 100. The heat sink 120 may include a number of fins 122 configured to provide a larger surface area than may otherwise be provided by the surface of the light source 110. The configuration of the fins 122 may be according to the direction of the incorporated references. For example, and without limitation, portions of a heat sink 120 may include one or more fins 122 that may be coupled with and positioned substantially perpendicular to a base portion 124.

In the embodiment of the invention illustrated in FIGS. 1C and 1D, the fins 122 may be configured to extend substantially the length of the heat sink 120 and to project radially outward from the generally annular base portion 124 in an elongate shape. Those skilled in the art will appreciate, however, that the present invention contemplates the use of fins 122 that extend any distance, and that the disclosed heat sink 120 that includes fins 122 that extend substantially the length thereof is not meant to be limiting in any way. Employment of multiple fins 122 may increase the surface area of the heat sink 120 and may permit thermal fluid flow between adjacent fins 122, thereby enhancing the cooling capability of the heat sink 120. Additionally, multiple fins 122 may be identical in shape. The illustrated embodiment shows the plurality of fins 122 being curved to advantageously provide additional surface area to provide additional dissipation of heat. More specifically, the width of each fin 122 (measured from a proximal edge to a distal edge of a fin 122) may be greater at a mounting end nearer the base portion 124 than opposite the mounting end. Those skilled in the art will readily appreciate, however, that the fins 122 of the heat sink 120 may be configured in any way while still accomplishing the many goals, features and advantages according to the present invention.

Figure 3:
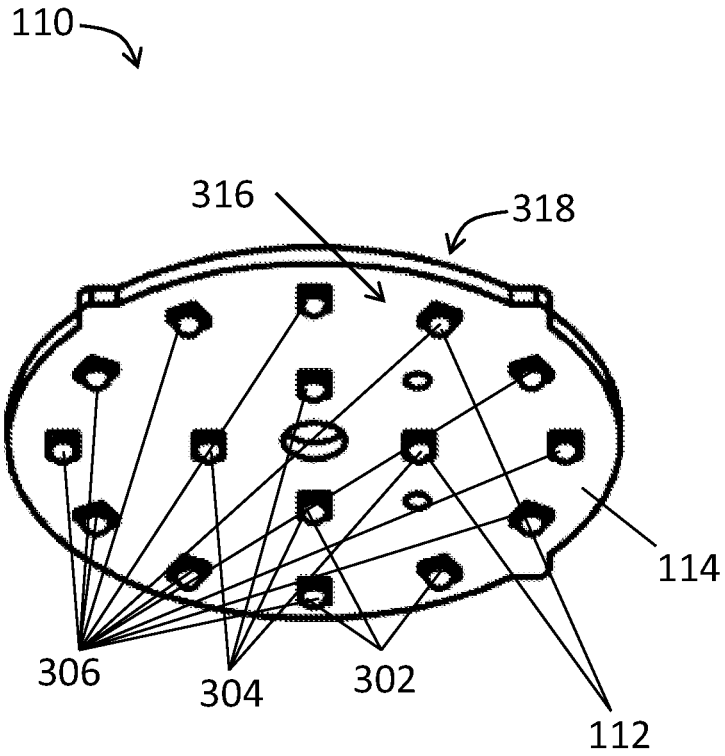
FIG. 3 is a perspective view of a light source of the magnetically-mountable lighting device depicted in FIG. 1A.

Referring additionally to FIG. 3, and continuing to refer to FIGS. 1C and 1D, the heat sink 120 may be positioned adjacent to and in thermal communication with the light source 110, which may comprise a top surface 316 and a bottom surface 318. For example, and without limitation, the heat sink 120 may present the substantially flat base portion 124 with which the bottom surface 318 of the light source 110 may come into thermal contact. The one or more fins 122 of a heat sink 120 may be configured as projecting flanges (as illustrated in FIG. 2) that may be positioned opposite the surface of the base portion 124 with which the light source 110 makes contact. Accordingly, and as may be understood by those skilled in the art, the heat sink 120 advantageously may provide additional surface area for heat that may be produced by the light source 110 to be dissipated. For example, and without limitation, the base portion 124 also may be configured to make mechanical contact with the light source 110, thereby fixing the orientation of the light source 110 within the lighting device 100 during normal operation. The base portion 124 of the heat sink 120 may be configured into any shape, including a circle, ovoid, square, rectangle, triangle, or any other polygon. For example, and without limitation, the light source 110 and the base portion 124 may be of a substantially matching shape, such as a circle, an oval, a square, a rectangle, a triangle, a regular polygon, and an irregular polygon.

The heat sink 120 may be made by molding, casting, or stamping of a thermally conductive material. Materials may include, without limitation, thermoplastic, ceramics, porcelain, aluminum, aluminum alloys, metals, metal alloys, carbon allotropes, and composite materials. Additional information directed to the use of heat sinks for dissipating heat in an illumination apparatus is found in U.S. Pat. No. 7,922,356 titled Illumination Apparatus for Conducting and Dissipating Heat from a Light Source, and U.S. Pat. No. 7,824,075 titled Method and Apparatus for Cooling a Light Bulb, the entire contents of each of which are incorporated herein by reference.

Continuing to refer to FIGS. 1D and 3, the light source 110 of the lighting device 100 according to an embodiment of the present invention is now discussed in greater detail. The light source 110 may include any device capable of emitting light. The light source 110 may comprise one or more light emitting elements 302. The light emitting elements 302 may, for example and without limitation, include light-emitting semiconductors, such as light-emitting diodes (LEDs), lasers, incandescent, halogens, arc-lighting devices, fluorescents, and any other digital light-emitting device known in the art. The light source 110 may include a first set of light emitting elements 304 and a second set of light emitting elements 306. In some embodiments of the present invention, the light source 110 may be an LED package. As illustrated in FIGS. 1D and 3, for example, and without limitation, the light source 110 may be an LED package that may include one or more LEDs 112 and a circuit board 114. The circuit board 114 may be configured to be functionally and/or mechanically coupled to the LEDs 112.

Referring again to FIG. 1C, the heat sink 120 may be positioned adjacent the light source 110 and may be thermally coupled to the light source 110. This thermal coupling may be accomplished by any method, including thermal adhesives, thermal pastes, thermal greases, thermal pads, and all other methods known in the art. Where a thermal adhesive, paste, or grease is used, the heat sink 120 may be connected to any part of the light source 110 as may effectively cause thermal transfer between the light source 110 and the heat sink 120. Connection point location largely may depend on the heat distribution within the light source 110. For example, the heat sink 120 may be thermally coupled to one or more LEDs 112, to the circuit board 114, or to both.

For example, and without limitation, the circuit board 114 of the light source 110 may be sized to couple to the base portion 124 of the heat sink 120. In the lighting device 100 presented in an assembled position as illustrated, for example, in FIG. 1C, the perimeter of the base portion 124 of the heat sink 120 may be aligned with the respective perimeter of the light source 110. The method of thermal coupling may be selected based on criteria including ease of application/installation, thermal conductivity, chemical stability, structural stability, and constraints placed by the lighting device 100.

Figure 4:
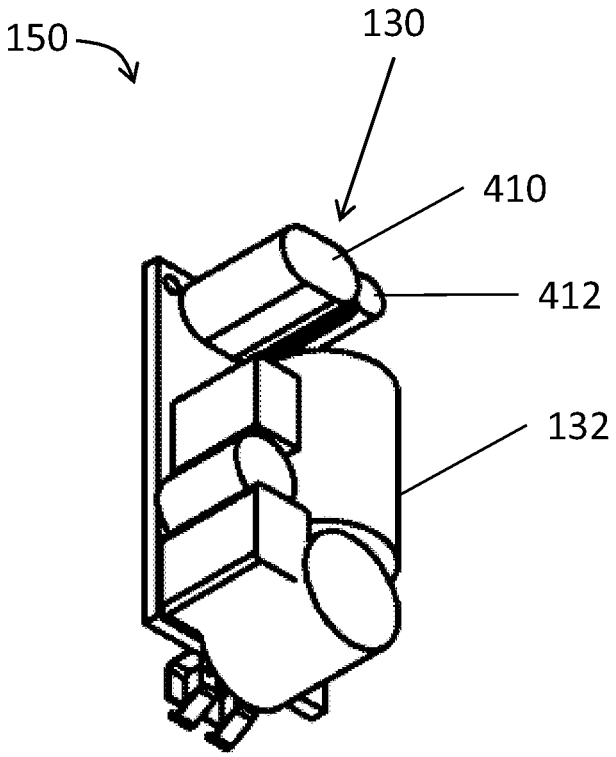
FIG. 4 is a perspective view of a component assembly of the magnetically-mountable lighting device depicted in FIG. 1A.

Referring now to FIG. 4, and continuing to refer to FIGS. 1C and 1D, the power source 130 of the lighting device 100, according to an embodiment of the present invention, is discussed in greater detail. The power source 130 may be mounted on a component assembly 150 circuit board and may be operably coupled with the light source 110. For example, and without limitation, the power source 130 may be in the form of an on-board power supply unit configured to deliver electrical power to the LEDs 110. The on-board power supply unit 130 may have a converter 410 that may convert an AC input voltage to a DC output voltage. The on-board power supply unit 130 also may have a regulator 412 that may sustain a DC output voltage within a target DC bias range.

In one embodiment, the on-board power supply unit 130 may have at least one induction coil (not shown) configured to receive an AC input voltage through inductive coupling. In another embodiment, the on-board power supply unit 130 may have at least one wire connector configured to receive the AC input voltage through conductive coupling. Alternatively, the power source 130 may be in the form of at least one power terminal (not shown) that receives power from a source external to the lighting device 100, and transmits that electrical power to the light source 110 and/or other electronic components comprising the component assembly 150. Additional information directed to the use of heat sinks for dissipating heat in an illumination apparatus is found in U.S. patent application Ser. No. 13/608,999 titled System for Inductively Powering an Electrical Device and Associated Methods, the entire contents of which are incorporated herein by reference.

Referring again to FIGS. 1A, 1B, 1C, and 1D, the enclosure 160 of the present embodiment will now be discussed in greater detail. The enclosure 160 may be may include a mounting base 162 and a sidewall 164 portion that may combine to define an interior volume known as a cavity 166. The cavity 166 may be configured to contain one or more of the light source 110, the heat sink 120, the power supply 130 and other components comprising the component assembly 150, and the magnetic attachment member 140. For example, and without limitation, the enclosure 160 may be constructed of a lightweight, thermal insulating material such as inorganic material, organic foam material, polyurethane material, polystyrene material, glass fiber material, aerogel material, and microporous material. Alternatively, or in addition, the enclosure 160 may be in thermal communication with the light source 110, the heat sink 120, and/or the power source 130. For example, and without limitation, the enclosure 150 may be constructed of a heat dissipating material such as thermoplastic, ceramics, porcelain, aluminum, aluminum alloys, metals, metal alloys, carbon allotropes, and composite materials.

Continuing to refer to FIGS. 1C and 1D, the magnetic attachment member 140 of the present embodiment will now be discussed in greater detail. The magnetic attachment member 140 may be used to fixedly or detachably mount a lighting device 100 to a ferromagnetic surface external to the lighting device 100. For example, and without limitation, the magnetic attachment member 140 may comprise a permanent magnet sized and shaped to be disposed within the cavity 166 of the enclosure 160 generally adjacent to the mounting base 162. As illustrated in FIG. 1D, for example, and without limitation, the magnetic attachment member 140 may have a generally annular shape allowing for a proximate fit to the mounting base 162. Such a configuration may position the magnetic attachment member 140 to provide mechanical support to the lighting device 100 by applying an upward force on the mounting base 162. More specifically, carrying force may be created in a direction of a ferromagnetic material external to the enclosure 160 of the lighting device 100 that may be brought into the magnetic field of the magnetic attachment member 140. The heat sink, the light source, and the power source may be mechanically coupled to the magnetic attachment member, and thereby carried by the magnetic attachment member when the lighting device is magnetically mounted to a external ferromagnetic material.

Continuing to refer to FIG. 1D, for example, and without limitation, the sidewall portion 164 of the enclosure 160 may be formed into any tubular shape, including a circle, ovoid, square, rectangle, triangle, or any other polygon. The cavity 166 formed by the substantially hollow interior of the tubular shape may be configured to receive various components and circuitry of the lighting device 100. For example, and without limitation, the cavity 166 may be configured to contain the power supply 130 and other electronic control devices comprising the component assembly 150. Also for example, and without limitation, the cavity 166 may present a cylinder of sufficient diameter to permit wires to pass therethrough from the light source 110 to the power supply 130 positioned adjacent the mounting base 162 of the enclosure 160. Those skilled in the art will appreciate that an electrical connector for the light source 110 may be provided by any type of connector that is suitable for connecting the light source 110 to a power source 130.

Continuing to refer to FIGS. 1C and 1D, the enclosure 160 may be positioned to substantially encase the heat sink 120 within the cavity 166. To permit fluid to flow unimpeded to the external environment from the cavity 166 after that fluid has traversed through the circuit board 114 to the heat sink 120, the enclosure 160 may comprise one or more vents (not shown) generally adjacent to the fins 122 of the heat sink 120. Alternatively, if a design object is to maintain a fluid seal between the cavity 166 and the environment external to the lighting device 100, the sidewall portion 164 may further include a sealing member (not shown). The sealing member may include any device or material that can provide a fluid seal as described above. For example, and without limitation, the sealing member may form a fluid seal between the sidewall portion 164 and the optic 170. Other embodiments may have the cavity 162 disposed on other parts of the enclosure 160.

Figure 5:
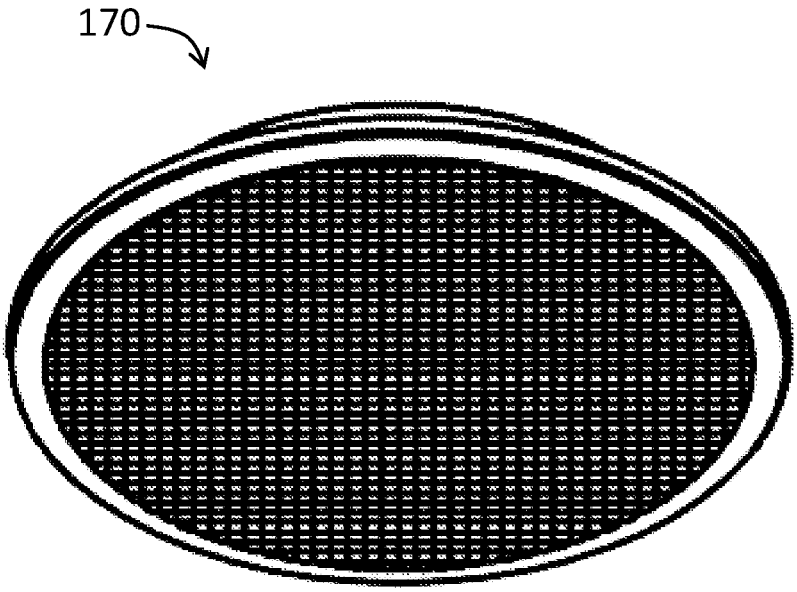
FIG. 5 is a perspective view of an optic of the magnetically-mountable lighting device depicted in FIG. 1A.

Referring now to FIG. 5, and continuing to refer to FIGS. 1A, 1B, 1C, and 1D, the optic 170 of the present embodiment will now be discussed in greater detail. The optic 170 may be attached to the enclosure 160 so as to define an optical chamber 172 into which light emitted by the light source 110 may enter and subsequently pass through the optic 170. In such a configuration, the optic 170 may substantially cover and obscure from view all of the components of the lighting device 100 that may be configured to be carried in the cavity 166 of the enclosure 160, thereby advantageously presenting a low-profile and aesthetically pleasing appearance of the lighting device 100. For example, and without limitation, the assembled configuration of the lighting device 100 may present a puck-like shape, defined as generally cylindrical and having a cylinder height that is less than the cylinder width.

Still referring to FIG. 1C, the cavity 166 may be configured to have spatial characteristics permitting fluid flow within the cavity 166. For example, and without limitation, the fluid flow within the cavity 166 may cause the transfer of heat from the light source 110 through the base portion 124 of the heat sink 120, which may then transfer the heat to the fins 122 and subsequently to the environment either internal or external to the enclosure 160 where the heat may dissipate. Accordingly, the spatial characteristics of the cavity 166 may directly correspond to the amount of heat that can be transported from the lighting device 100 to the dissipating environment. Spatial characteristics that can be modified may include total volume, fluid flow characteristics, interior surface area, and exterior surface area. For example, and without limitation, one or more surfaces of the enclosure 160 may be textured or include grooves to increase the surface area of the enclosure 160, thereby facilitating thermal transfer thereto. Moreover, thermal properties of the materials used to form the enclosure 160 may be considered in forming the thermal management system for the lighting device 100.

The aforementioned spatial characteristics may be modified to accommodate the heat generated by the light source 110 of the lighting device 100. For instance, the volume of the cavity 166 may be directly proportional to the thermal output of the lighting device 100. Similarly, a surface area of some part of the heat sink 120 may be proportional to the thermal output of the lighting device 100. In any case, the cavity 166 may be configured to maintain the temperature of the lighting device 100 at thermal equilibrium or within a target temperature range.

As illustrated in FIG. 1C, the enclosure 160 may include an attaching lip 168 that may be configured to receive the optic 170. More specifically, the optic 170 may interface with the attaching lip 168 to attach to and be carried by the enclosure 160. For example, and without limitation, the optic 170 may form an interference fit with the attaching lip 168, the interference fit providing sufficient strength to carry the optic 170 thereby. Optionally, the optic 170 may be attached to the attaching lip 168 through the use of an adhesive, glue, or any other attachment method known in the art.

The optic 170 may be configured to interact with light emitted by the light source 110 to refract incident light. Accordingly, the light source 110 may be disposed such that light emitted therefrom is incident upon the optic 170. The optic 170 may be formed in any shape to impart a desired refraction. In the present embodiment, the optic 170 has a generally flat geometry. Furthermore, the optic 170 may be formed of any material with transparent or translucent properties that comport with the desired refraction to be performed by the optic 170. Additionally, the optic 170 may be configured to generally diffuse light incident thereupon.

As shown in FIG. 1D, an end of the enclosure 160 substantially opposite the optic 170 may be configured to define an aperture. A circuit board receiving groove 152 may be presented as a notch in the mounting base 162 positioned at the end generally opposite the aperture. The component assembly 150 may be mounted in the circuit board receiving groove 152 to form a seal.

Referring now to the schematic representation illustrated in FIG. 6, a system 600 for operating a magnetically-mountable lighting device 100 according to an embodiment of the present invention will now be described in greater detail. The logical components of the lighting device 100 may include a controller 132 and the light source 110. For example, and without limitation, the light source 110 may comprise a plurality of LEDs each arranged to generate a source light. The controller 132 may be designed to control the characteristics of the combined light emitted by the light source 110. The controller 132 may execute control program instructions using a processor 602 that may accept and execute computerized instructions, and also a data store 603 which may store data and instructions used by the processor 602.

Referring additionally to FIGS. 1C and 4, for example, and without limitation, the controller 132 may be included in the component assembly 150 for positioning within the enclosure 160 (FIG. 1C). The controller 132 may be positioned so as to be electrical communication with the power supply 130 so as to be rendered operational. Additionally, the controller 132 may be operably connected to the light source 110 so as to control the operation of the light source 600. The controller 132 may be configured to operate the light source 110 between operating and non-operating states, wherein the light source 110 emits light when operating, and does not emit light when not operating. Furthermore, where the light source 110 includes a plurality of light-emitting elements 302 (as illustrated in FIG. 3), the controller 132 may be operably connected to the plurality of light emitting elements 302.

Yet further, the controller 132 may be operably connected to the plurality of light-emitting elements 302 so as to selectively operate each of the plurality of light-emitting elements 302. Accordingly, the controller 132 may be configured to operate the light-emitting elements 302 as described hereinabove. Moreover, the controller 132 may be configured to operate the light-emitting elements 302 so as to control the color, color temperature, and distribution of light produced by the lighting device 100 into the environment surrounding the lighting device 100 as described hereinabove.

In addition to selective operation of each of the plurality of light-emitting elements 302, the controller 132 may be configured to operate each of the plurality of light-emitting elements 302 so as to cause each light-emitting element 302 to emit light either at a full intensity or a fraction thereof. Many methods of dimming, or reducing the intensity of light emitted by a light-emitting element, are known in the art. Where the light-emitting elements 302 are LEDs, the controller 132 may use any method of dimming known in the art, including, without limitation, pulse-width modulation (PWM) and pulse-duration modulation (PDM). This list is exemplary only and all other methods of dimming a light-emitting element is contemplated and within the scope of the invention. Further disclosure regarding PWM may be found in U.S. Pat. No. 8,384,984 titled MEMS Wavelength Converting Lighting Device And Associated Methods, filed Mar. 28, 2011, the entire contents of which are incorporated by reference hereinabove.

Figure 6:
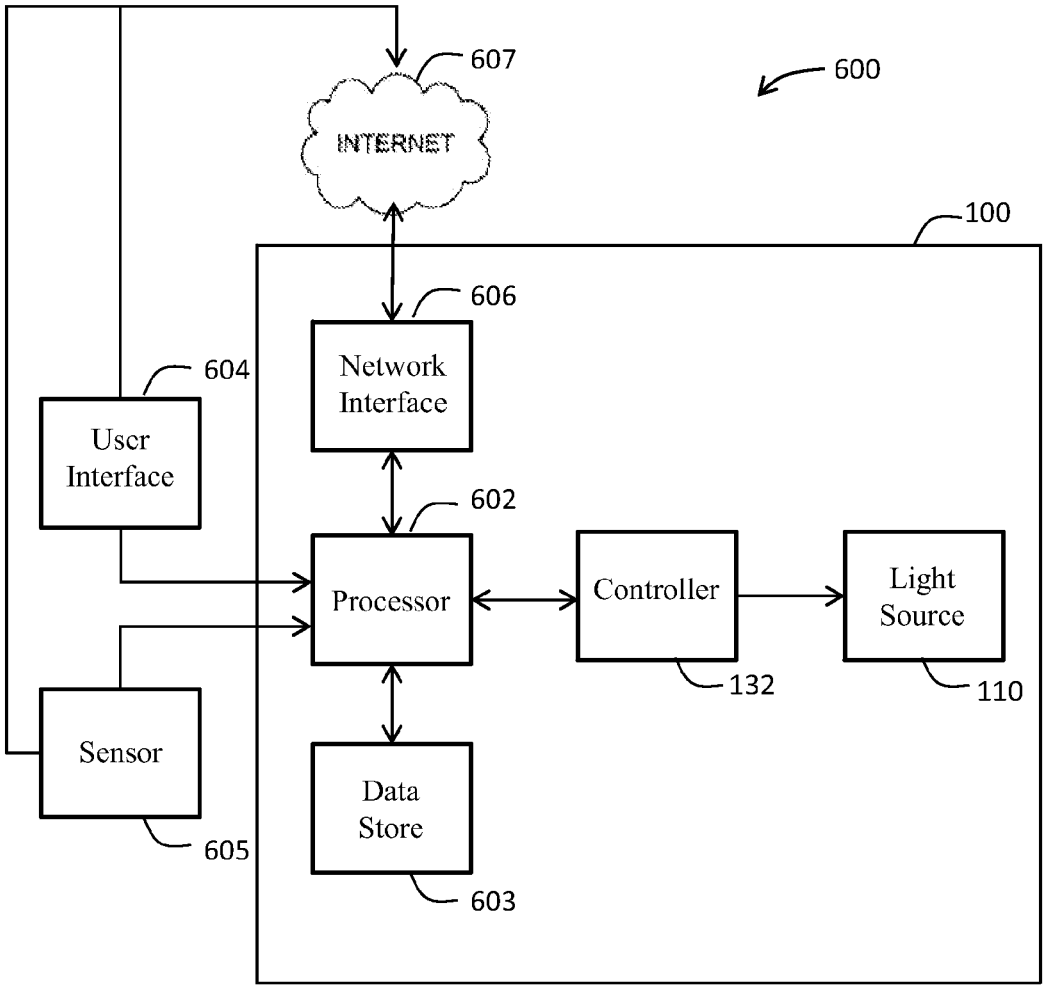
FIG. 6 is a schematic block diagram of a magnetically-mountable lighting device according to an embodiment of the present invention.

Continuing to refer to FIG. 6, the lighting device 100 may comprise a user interface 604 and/or a sensor 605 configured to program the controller 132 to control the emissions characteristics of the light source 110. More specifically, the processor 602 may be configured to receive the input transmitted from some number of control devices 604, 605 and to direct that input to the data store 603 for storage and subsequent retrieval. For example, and without limitation, the processor 602 may be in data communication with the device 604, 605 through a direct connection and/or through a network connection 606 to a network 607. Referring additionally to FIGS. 1C and 1D, for example, and without limitation, the user interface 604 may comprise a beam adjustment device 135 that may be configured to electronically communicate beam characteristics to the controller 132. The controller 132 may be programmed to selectively operate the light source 119 in response to the beam characteristics instructions received. Operation of the beam adjustment device 135 may be electrical, electronic, electromagnetic, or magnetic. For example, and without limitation, the beam adjustment device illustrated in FIG. 1C may operate manually responsive to manipulation of twist knob and/or a tunable lens 165 deployed as a section of sidewall 165 of the enclosure 160 that moves like a dial to signal physical adjustment of the emission characteristics of the light source 110.

Also for example, and without limitation, the component assembly 150 of the lighting device 100 may comprise a signal receiver and/or a signal transmitter. The controller 132 may be programmed to selectively operate the light source 110 in response to electronic communication received from an external device 604, 605 through the signal receiver. The controller 132 also may be configured to transmit beam characteristics to an external device (such as another lighting device 100) through the signal transmitter to a network 607.

Also for example, and without limitation, the sensor 605 may comprise an occupancy sensor and/or a timer may be employed for automatic selection and communication of beam characteristics to the controller 132. The sensor 605 may transmit a signal to the controller 132 indicating that the controller 132 should either operate the light source 110 or cease operation of the light source 110. For example, the sensor 605 may be an occupancy sensor that detects the presence of a person within a field of view of the occupancy sensor 605. When a person is detected, the occupancy sensor 605 may indicate to the controller 132 that the light source 110 should be operated so as to provide lighting for the detected person. Accordingly, the controller 132 may operate the light source 110 so as to provide lighting for the detected person.

Furthermore, the occupancy sensor 605 may either indicate that lighting is no longer required when a person is no longer detected, or either of the occupancy sensor 605 or the controller 132 may indicate lighting is no longer required after a period of time transpires during which a person is not detected by the occupancy sensor 605. Accordingly, in either situation, the controller 132 may cease operation of the light source 110, terminating lighting of the environment surrounding the lighting device 100. The sensor 605 may be any sensor capable of detecting the presence or non-presence of a person in the environment surrounding the lighting device 100, including, without limitation, infrared sensors, motion detectors, and any other sensor of similar function known in the art. More disclosure regarding motion-sensing lighting devices and occupancy sensors may be found in U.S. patent application Ser. No. 13/403,531, entitled Configurable Environmental Sensing Luminaire, System and Associated Methods, filed Feb. 23, 2012, and U.S. patent application Ser. No. 13/464,345, entitled Occupancy Sensor and Associated Methods, filed May 4, 2012, the entire contents of both of which are herein incorporated by reference.

Figure 7:
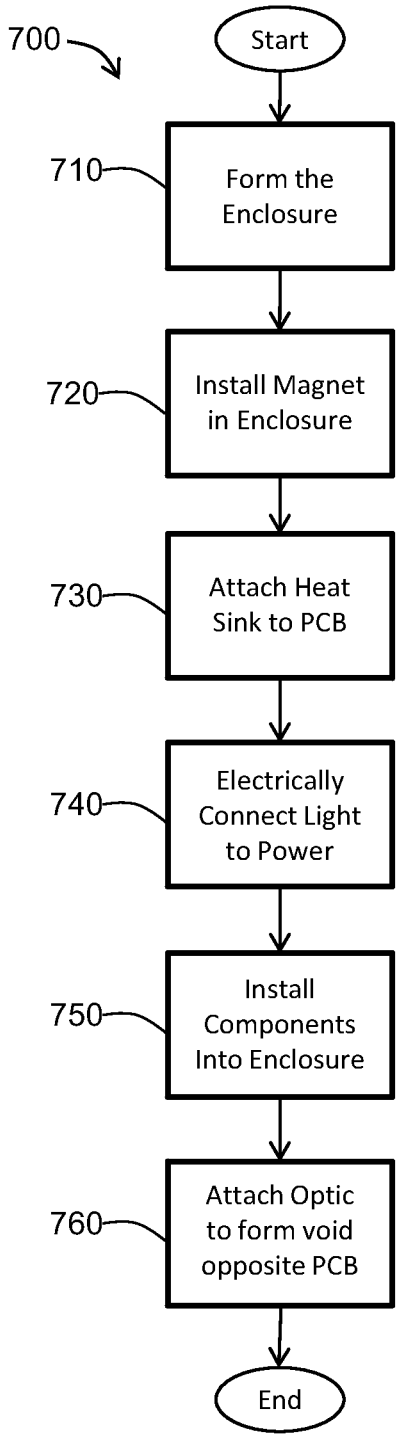
FIG. 7 is a flow chart detailing a method of manufacturing a modular cooling system as used in connection with an embodiment of the magnetically mountable lighting device according to the present invention.

Referring now to FIG. 7, a method aspect for assembling a lighting device adapted to be carried through magnetic binding to a ferromagnetic material may include the steps of forming the enclosure at Block 710. Forming the enclosure may include forming the mounting base 162 and sidewall 164 portions of the enclosure 160 to define a cavity 166. At Block 720, the magnetic attachment member 140 may be attached to the mounting base 162 and/or sidewall 164 portions of the enclosure. At Block 730, the light source 110 may be positioned in thermal communication with the heat sink 120, and at Block 740, the light source 110 may be positioned in electrical communication with the power source 130. At Block 750, the components may be installed into the enclosure. This may include inserting the heat sink 120, light source, 110 and power source 130 into the cavity 166 of the enclosure 160. At Block 760, the optic may be attached to form a void opposite the printed circuit board (PCB). This may include attaching the optic 170 in a position substantially covering the cavity 166 of the enclosure 160 and such that the optic 166 is in optical communication with the light source 110.

Figure 8:
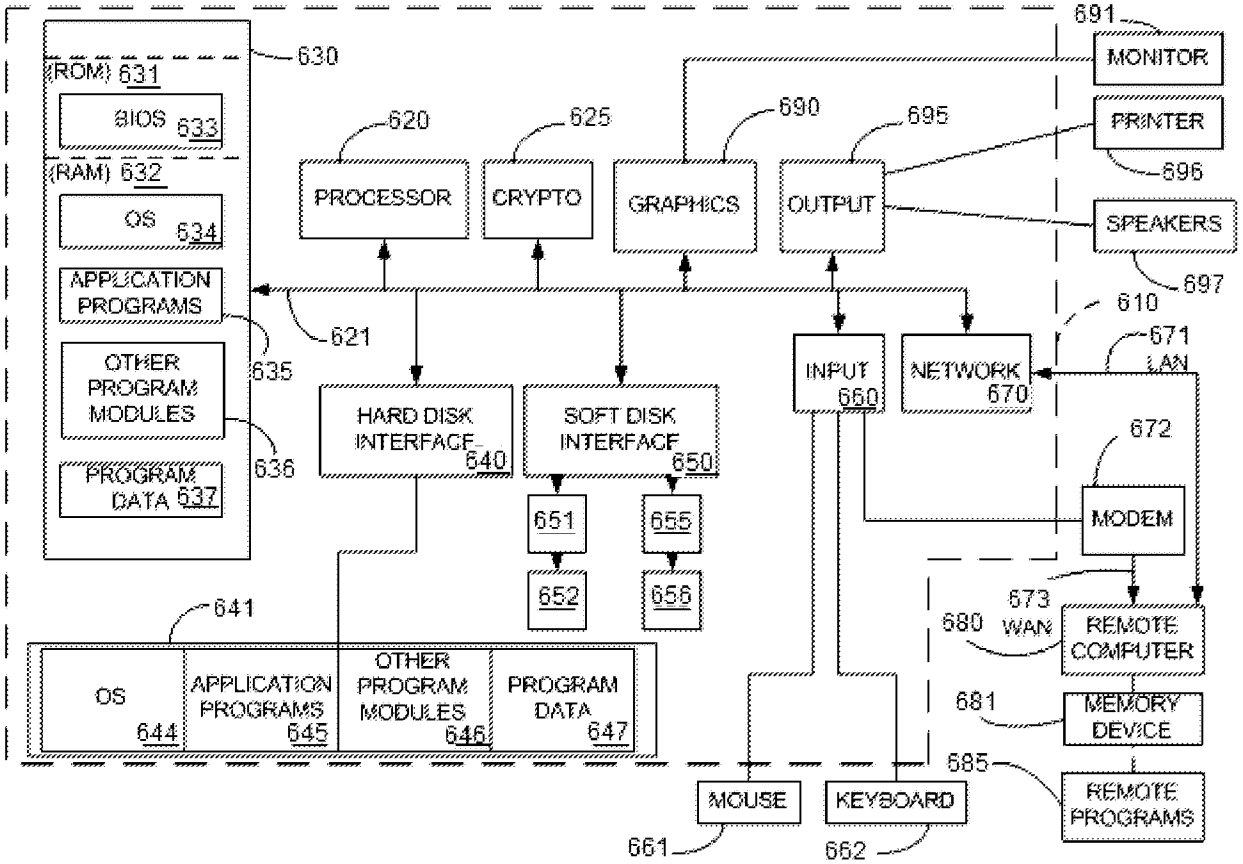
FIG. 8 is a block diagram representation of a machine in the example form of a computer system according to an embodiment of the present invention.

A skilled artisan will note that one or more of the aspects of the present invention may be performed on a computing device. The skilled artisan will also note that a computing device may be understood to be any device having a processor, memory unit, input, and output. This may include, but is not intended to be limited to, cellular phones, smart phones, tablet computers, laptop computers, desktop computers, personal digital assistants, etc. FIG. 8 illustrates a model computing device in the form of a computer 610, which is capable of performing one or more computer-implemented steps in practicing the method aspects of the present invention. Components of the computer 610 may include, but are not limited to, a processing unit 620, a system memory 630, and a system bus 621 that couples various system components including the system memory to the processing unit 620. The system bus 621 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI).

The computer 610 may also include a cryptographic unit 625. Briefly, the cryptographic unit 625 has a calculation function that may be used to verify digital signatures, calculate hashes, digitally sign hash values, and encrypt or decrypt data. The cryptographic unit 625 may also have a protected memory for storing keys and other secret data. In other embodiments, the functions of the cryptographic unit may be instantiated in software and run via the operating system.

A computer 610 typically includes a variety of computer readable media. Computer readable media can be any available media that can be accessed by a computer 610 and includes both volatile and nonvolatile media, removable and non-removable media. By way of example, and not limitation, computer readable media may include computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, FLASH memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer 610. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency, infrared and other wireless media. Combinations of any of the above should also be included within the scope of computer readable media.

The system memory 630 includes computer storage media in the form of volatile and/or nonvolatile memory such as read only memory (ROM) 631 and random access memory (RAM) 632. A basic input/output system 633 (BIOS), containing the basic routines that help to transfer information between elements within computer 610, such as during start-up, is typically stored in ROM 631. RAM 632 typically contains data and/or program modules that are immediately accessible to and/or presently being operated on by processing unit 620. By way of example, and not limitation, FIG. 8 illustrates an operating system (OS) 634, application programs 635, other program modules 636, and program data 637.

The computer 610 may also include other removable/non-removable, volatile/nonvolatile computer storage media. By way of example only, FIG. 8 illustrates a hard disk drive 641 that reads from or writes to non-removable, nonvolatile magnetic media, a magnetic disk drive 651 that reads from or writes to a removable, nonvolatile magnetic disk 652, and an optical disk drive 655 that reads from or writes to a removable, nonvolatile optical disk 656 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 641 is typically connected to the system bus 621 through a non-removable memory interface such as interface 640, and magnetic disk drive 651 and optical disk drive 655 are typically connected to the system bus 621 by a removable memory interface, such as interface 650.

The drives, and their associated computer storage media discussed above and illustrated in FIG. 8, provide storage of computer readable instructions, data structures, program modules and other data for the computer 610. In FIG. 8, for example, hard disk drive 641 is illustrated as storing an OS 644, application programs 645, other program modules 646, and program data 647. Note that these components can either be the same as or different from OS 633, application programs 633, other program modules 636, and program data 637. The OS 644, application programs 645, other program modules 646, and program data 647 are given different numbers here to illustrate that, at a minimum, they may be different copies. A user may enter commands and information into the computer 610 through input devices such as a keyboard 662 and cursor control device 661, commonly referred to as a mouse, trackball or touch pad. Other input devices (not shown) may include a microphone, joystick, game pad, satellite dish, scanner, or the like. These and other input devices are often connected to the processing unit 620 through a user input interface 660 that is coupled to the system bus, but may be connected by other interface and bus structures, such as a parallel port, game port or a universal serial bus (USB). A monitor 691 or other type of display device is also connected to the system bus 621 via an interface, such as a graphics controller 690. In addition to the monitor, computers may also include other peripheral output devices such as speakers 697 and printer 696, which may be connected through an output peripheral interface 695.

The computer 610 may operate in a networked environment using logical connections to one or more remote computers, such as a remote computer 680. The remote computer 680 may be a personal computer, a server, a router, a network PC, a peer device or other common network node, and typically includes many or all of the elements described above relative to the computer 610, although only a memory storage device 681 has been illustrated in FIG. 8. The logical connections depicted in FIG. 8 include a local area network (LAN) 671 and a wide area network (WAN) 673, but may also include other networks 140. Such networking environments are commonplace in offices, enterprise-wide computer networks, intranets and the Internet.

When used in a LAN networking environment, the computer 610 is connected to the LAN 671 through a network interface or adapter 670. When used in a WAN networking environment, the computer 610 typically includes a modem 672 or other means for establishing communications over the WAN 673, such as the Internet. The modem 672, which may be internal or external, may be connected to the system bus 621 via the user input interface 660, or other appropriate mechanism. In a networked environment, program modules depicted relative to the computer 610, or portions thereof, may be stored in the remote memory storage device. By way of example, and not limitation, FIG. 8 illustrates remote application programs 685 as residing on memory device 681.

The communications connections 670 and 672 allow the device to communicate with other devices. The communications connections 670 and 672 are an example of communication media. The communication media typically embodies computer readable instructions, data structures, program modules or other data in a modulated data signal such as a carrier wave or other transport mechanism and includes any information delivery media. A "modulated data signal" may be a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Computer readable media may include both storage media and communication media.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Many modifications and other embodiments of the invention will come to the mind of one skilled in the art having the benefit of the teachings presented in the foregoing descriptions and the associated drawings. The scope of the invention should be determined by the appended claims and their legal equivalents, and not by the examples given Therefore, it is understood that the invention is not to be limited to the specific embodiments disclosed.

What is claimed is:

1. A lighting device comprising:

an enclosure having a sidewall portion that defines a tubular cavity having a first end and a second end, and a base portion that comprises an interior and an exterior, wherein the interior of the base portion is positioned adjacent the first end of the tubular cavity and wherein the exterior of the base portion is positioned opposite the tubular cavity to define a mounting surface;

a magnetic attachment member comprising a permanent magnet, and configured to proximately fit a perimeter of the interior of the base portion of the enclosure;

a heat sink;

a light source in thermal communication with the heat sink; and an on-board power supply unit operatively coupled to the light source;

wherein the magnetic attachment member is positioned adjacent the interior of the base portion within the tubular cavity and is configured to magnetically bind to a ferromagnetic material that is positionable adjacent to and substantially conforms to the mounting surface of the base portion; and wherein the heat sink, the light source, the on-board power supply unit, and the magnetic attachment member are coupled to the enclosure.

2. A lighting device according to claim 1 wherein the heat sink comprises a plurality of heat-dissipating fins.

3. A lighting device according to claim 1 wherein the heat sink comprises at least one thermally conductive material selected from the group consisting of thermoplastic, ceramic, porcelain, aluminum, and aluminum alloys.

4. A lighting device according to claim 1 wherein the on-board power supply unit comprises at least one of a converter and a regulator; wherein the converter is configured to convert an AC input voltage to a DC output voltage; wherein the regulator is configured to sustain a DC output voltage within a target DC bias range.

5. A lighting device according to claim 4 wherein the on-board power supply unit comprises at least one induction coil configured to receive the AC input voltage through inductive coupling.

6. A lighting device according to claim 4 wherein the on-board power supply unit comprises at least one wire connector configured to receive the AC input voltage through conductive coupling.

7. A lighting device according to claim 1 wherein the light source comprises one or more light emitting diodes (LEDs).

8. A lighting device according to claim 7 further comprising:

a controller operably coupled to the one or more LEDs;

a beam adjustment device configured to electronically communicate beam characteristics to the controller;

wherein the controller is programmable to selectively operate at least a portion of the one or more LEDs in response to the electronically communicated beam characteristics received by the controller from the beam adjustment device.

9. A lighting device according to claim 8 wherein the beam adjustment device is selected from at least one of a manual selection type and an automatic selection type; wherein the manual selection type is selected from the group consisting of a twist knob and a tunable lens; and wherein the automatic selection type selected from the group consisting of an occupancy sensor and a timer.

10. A lighting device according to claim 8 wherein the beam adjustment device is of an adjustment operation type selected from the group consisting of electrical, magnetic, electromagnetic, and electronic.

11. A lighting device according to claim 8 further comprising a signal receiver; wherein the controller is programmable to selectively operate at least a portion of the one or more LEDs in response to an electronic communication received by the controller from an external device through the signal receiver.

12. A lighting device according to claim 8 further comprising a signal transmitter configured to transmit to an external device the electronically communicated beam characteristics received by the controller from the beam adjustment device.

13. A lighting device according to claim 1 wherein the tubular cavity in the enclosure is configured to carry one or more of the heat sink, the light source, the on-board power supply unit, and the magnetic attachment member.

14. A lighting device according to claim 1 wherein at least one of the heat sink, the light source, and the on-board power supply unit are in thermal communication with the enclosure.

15. A lighting device according to claim 1 further comprising an optic attached to the enclosure and positioned adiacent the second end of the tubular cavity; wherein the optic defines within the tubular cavity an optical chamber, and wherein light emitted by the light source enters the optical chamber and passes through the optic.

16. A lighting device comprising:

an enclosure having a sidewall portion that defines a tubular cavity having a first end and a second end, and a base portion that comprises an interior and an exterior, wherein the interior of the base portion is positioned adjacent the first end of the tubular cavity and wherein the exterior of the base portion is positioned opposite the tubular cavity to define a mounting surface;

a magnetic attachment member comprising a permanent magnet, and configured to proximately fit a perimeter of the interior of the base portion of the enclosure;

a heat sink;

a light source in thermal communication with the heat sink; and at least one power terminal electrically coupled to the light source;

wherein the magnetic attachment member is positioned adjacent the interior of the base portion within the tubular cavity and is configured to magnetically bind to a ferromagnetic material that is positionable adjacent to and substantially conforms to the mounting surface of the base portion; and wherein the heat sink, the light source, the at least one power terminal, and the magnetic attachment member are coupled to the enclosure.

17. A lighting device according to claim 16 further comprising:

a controller operably coupled to the light source;

a beam adjustment device configured to electronically communicate beam characteristics to the controller;

wherein the controller is programmable to selectively operate the light source in response to the electronically communicated beam characteristics received by the controller from the beam adjustment device.

18. A lighting device according to claim 16 wherein the light source comprises one or more light emitting diodes (LEDs).

19. A lighting device according to claim 18 wherein the tubular cavity in the enclosure is configured to carry at least one of the heat sink, the one or more LEDs, the at least one power terminal, and the magnetic attachment member; wherein at least one of the heat sink, the one or more LEDs, and the at least one power terminal is in thermal communication with the enclosure.

20. A method for assembling a lighting device, the lighting device comprising an enclosure having a sidewall portion that defines a tubular cavity having a first end and a second end, and a base portion that comprises an interior and an exterior, wherein the interior of the base portion is positioned adjacent the first end of the tubular cavity and wherein the exterior of the base portion is positioned opposite the tubular cavity to define a mounting surface; a heat sink; one or more light emitting diodes (LEDs); an on-board power supply unit; a magnetic attachment member configured to proximately fit a perimeter of the interior of the base portion of the enclosure; and an optic; the method comprising the steps of:

positioning the magnetic attachment member adjacent the interior of the base portion within the tubular cavity;

positioning the one or more LEDs in thermal communication with the heat sink;

positioning the one or more LEDs in electrical communication with the on-board power supply unit;

inserting the heat sink, one or more LEDs, and on-board power supply unit into the enclosure through the second end of the tubular cavity;

positioning the lighting device to magnetically bind the magnetic attachment member to a ferromagnetic material that is positionable adjacent to and substantially conforms to the mounting surface of the base portion; and attaching the optic in a position substantially covering the second end of the tubular cavity of the enclosure and such that the optic is in optical communication with the one or more LEDs.

* * * * *